US005444880A

United States Patent [19]

Weismiller et al.

[11] Patent Number: 5,444,880

[45] Date of Patent: Aug. 29, 1995

[54] BED WITH EMERGENCY HEAD RELEASE AND AUTOMATIC KNEE DOWN

[75] Inventors: Matthew W. Weismiller, Batesville; John R. Wilker, Jr., Greensburg; David A. Albersmeyer; Peter M. Wukusick, both of Batesville; Kenneth L. Kramer, Greensburg, all of Ind.

[73] Assignee: Hill-Rom Company, Inc., Batesville, Ind.

[21] Appl. No.: 147,166

[22] Filed: Nov. 3, 1993

[51] Int. Cl.[6] ..... A61G 7/06

[52] U.S. Cl. ..... 5/424; 5/613; 5/611; 5/618; 74/89.15; 74/98

[58] Field of Search ..... 5/613, 616, 617, 618, 5/424; 74/39.15, 98

[56] References Cited

U.S. PATENT DOCUMENTS 4,038,709 8/1977 Kerwit ..... 5/614 X
4,346,487 8/1982 Holdt et al. ..... 5/617
4,559,655 12/1985 Peck ..... 5/616
4,953,243 9/1990 Birkmann .
5,129,116 7/1992 Borders et al. .
5,161,274 11/1992 Hayes et al. .
5,329,657 6/1994 Bartley et al. ..... 5/616 X

FOREIGN PATENT DOCUMENTS 2146241 4/1985 United Kingdom ..... 5/617

*Primary Examiner*—Michael F. Trettel
*Attorney, Agent, or Firm*—Barnes & Thornburg

[57] ABSTRACT

A manual CPR release for a hospital bed mechanically releases the head section from the head drive motor to quickly lower the head section to a flat position. When the head section reaches its lower limit, a switch is actuated which produces a command signal initiating the operation of both the head and knee drive motors. The knee drive motor lowers the thigh and foot sections to their flat positions and brings them into a coplanar position with the head section. Operating the head drive motor moves the head drive nut back into mechanical engagement with the head section.

26 Claims, 6 Drawing Sheets

BED WITH EMERGENCY HEAD RELEASE AND AUTOMATIC KNEE DOWN

BACKGROUND OF THE INVENTION

1. Field of the Invention

The present invention relates generally to the area of beds in which upper and lower body sections of a user are independently supported by adjustable articulated bed sections, and more particularly, to a bed in which the bed sections are automatically moved to an approximately coplanar position in response to a single discrete manual actuation of a control device.

2. Description of Related Art

Hospital beds having independently moveable articulated head, knee and foot sections are well known. Typically the articulated bed sections are connected to drive mechanisms independently powered by electric motors. The beds contain pushbuttons or other input devices which may be used to operate the motors in different combinations to achieve a desired configuration of the articulated sections.

U.S. Pat. No. 4,559,655 discloses a hospital bed in which the articulated head and knee sections of the bed are connected to independent drive mechanisms and motors. In the event of an emergency, it is desirable to lower the head section at a rate substantially in excess of that provided by the normal operation of the motor. Therefore, a manually operated control is provided for disengaging the head section from its drive thereby permitting the head section to be moved rapidly downward independent of the drive and motor. The above device positions the upper torso of the patient in the optimum position for immediate treatment in an emergency cardiac situation. However, the device does not control or activate any change of position of the lower torso supported by the knee section of the bed. To change the position of the lower torso, the motor controlling the position of the knee section must be operated by separate manual controls in order to move the articulated thigh and foot sections of the knee section into a position coplanar with the head section. The manual control must be continuously activated by an operator for the full time the articulated thigh and foot sections are moving. Alternatively, the thigh and foot sections may be manually lowered to the desired coplanar position.

U.S. Pat. No. 4,953,243 provides for an automatic hands-free repositioning of a hospital bed to a full-up flat position upon entry of a coded command by an attendant. The coded command is created by the attendant activating a pre-existing hand switch simultaneously with a pre-existing foot control. Preferably, the attendant activates the bed-up foot control and the programmed Trendelenburg hand switch. The bed control has a logic circuit which is responsive to those two commands for simultaneously producing bed-up knee-down and back-down motor command signals. The requirements of a combination of hand and foot commands by the attendant is utilized to prevent the patient from inadvertently inputting the coded command.

The above designs have the disadvantage of either requiring extra manpower or extra time in order to move all of the articulated bed sections to the desired co-planar position. In the first case, the requirement of an independent operation to power drive the thigh and foot sections diverts attention from the immediate emergency treatment being provided. In the other case, hospital bed motors are typically operated at relatively low speeds to prevent discomfort to the patient. Therefore, using the motors to move the bed to the desired co-planar position requires substantial time; and in a CPR emergency, the less time to move the bed, the better.

SUMMARY OF THE INVENTION

To overcome the disadvantages of the above described mechanisms, the present invention, in response to a single actuation of a release control, first, automatically disconnects the head section of a hospital bed from its drive to quickly drop the head section to its desired CPR position; and second, automatically moves the thigh and foot sections with their drive motor to their desired positions.

According to the principles of the present invention and according to the described embodiments, a bed has articulated head, thigh and foot sections pivotally connected to each other. The head section is connected to a motorized upper drive, and the thigh and foot sections are connected to a motorized lower drive. The bed includes a manually actuated release mechanism. A single discrete actuation of a manual release control on the release mechanism disconnects the upper drive from the head section thereby freeing the head section to be manually pushed downward and/or pulled downward by gravity. The release mechanism includes a switch which responds to actuation of the release mechanism to automatically command the lower drive to move the thigh and foot sections into an approximate coplanar relationship with the head section. The switch simultaneously commands the upper drive to reconnect the upper drive to the head section.

The present invention has the advantage using a single control to quickly provide a flat head section and automatically provide a fully flat bed with a single discrete actuation of the single control. Further, rapidly moving the head, knee and foot sections to a coplanar position allows immediate orientation of the bed into the Trendelenburg position, if desired.

These and other objects and advantages of the present invention will become more readily apparent during the following detailed description in conjunction with the drawings herein.

DETAILED DESCRIPTION OF THE INVENTION

Figure 1:
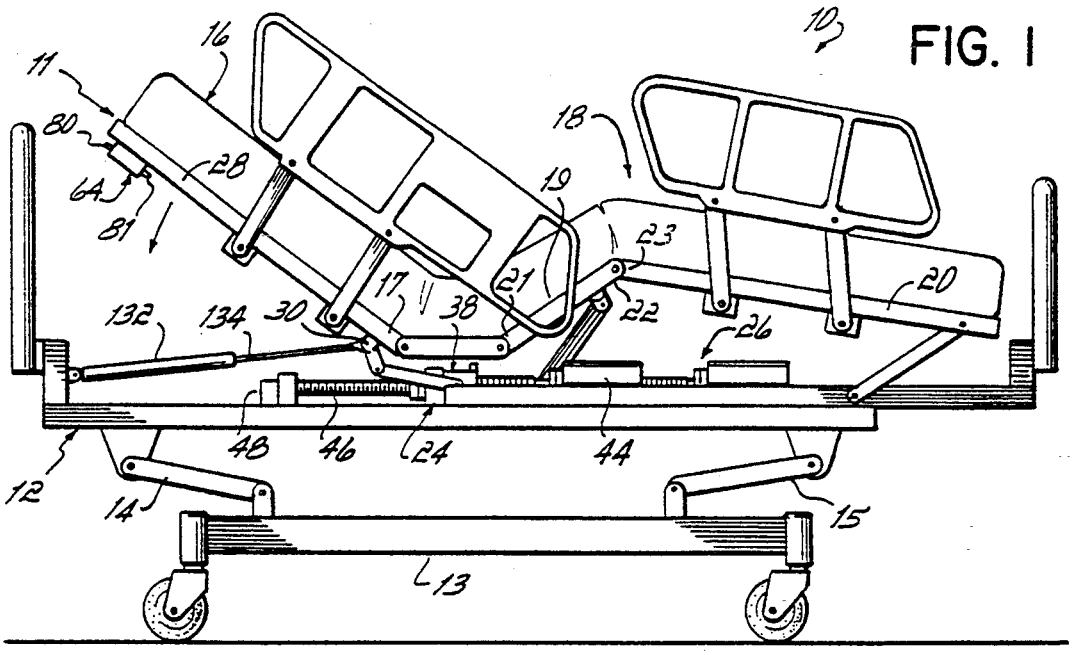
FIG. 1 is a side elevation view illustrating a hospital bed with both the upper and lower body sections raised.
Figure 2:
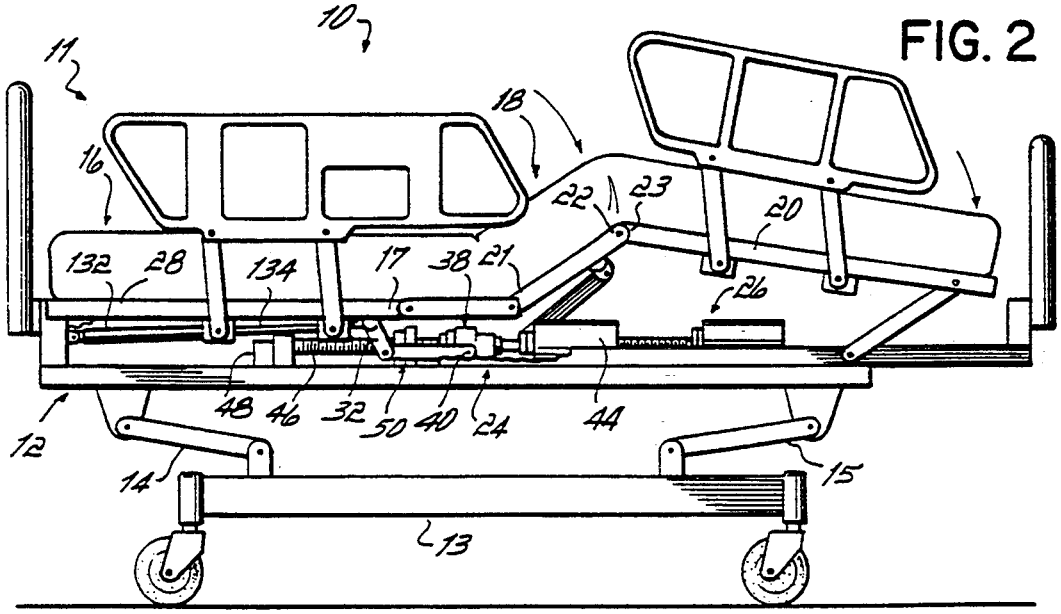
FIG. 2 is a side elevation view illustrating a hospital bed with the upper body section lowered and the lower body section raised.
Figure 3:
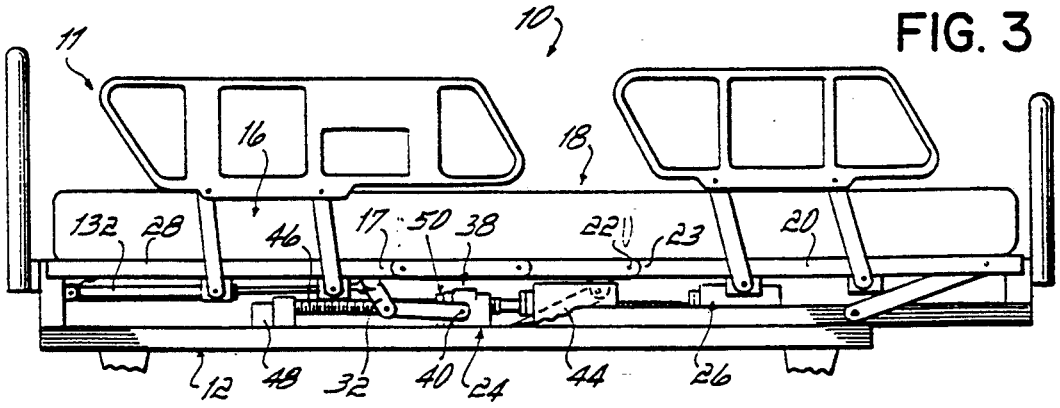
FIG. 3 is a partial side elevation view illustrating a hospital bed with both the upper and lower body sections lowered to a flat horizontal position.

FIGS. 1–3 illustrate a hospital bed employing the present invention. The bed 10 includes a body support assembly 11 mounted on a base 13. The body support assembly 11 has a support frame 12 connected to a base 13 by means of mechanical drives 14 and 15 which are connected to motors (not shown). The body support assembly 11 further includes an upper body section, i.e., head section, 16 having one end 17 pivotally linked to a lower body section, i.e., knee section, 18 which includes a thigh section 19 and a foot section 20. The one end 17 of the head section is pivotally linked to one end 21 of the thigh section 19, and the other end 22 of the thigh section 19 is pivotally connected to one end 23 of the foot section 20. The inclination position of the head section 16 is controlled by an upper drive, i.e., head drive, 24 pivotally linked to the head section 16. The inclination positions of the thigh section 19 and the foot section 20 of the lower section 18 are controlled by a lower drive, i.e., knee drive, 26 pivotally linked to the knee section 18. FIG. 1 illustrates a typical position for a hospital bed in which the head and knee sections 16 and 18, respectively, are positioned such that a patient is in a reclined position with the head and knees raised. In the event of an emergency, such as, for example, an emergency cardiac situation, it is desirable that the head section 16 drop quickly to a flat position as illustrated in FIG. 2.

Figure 4:
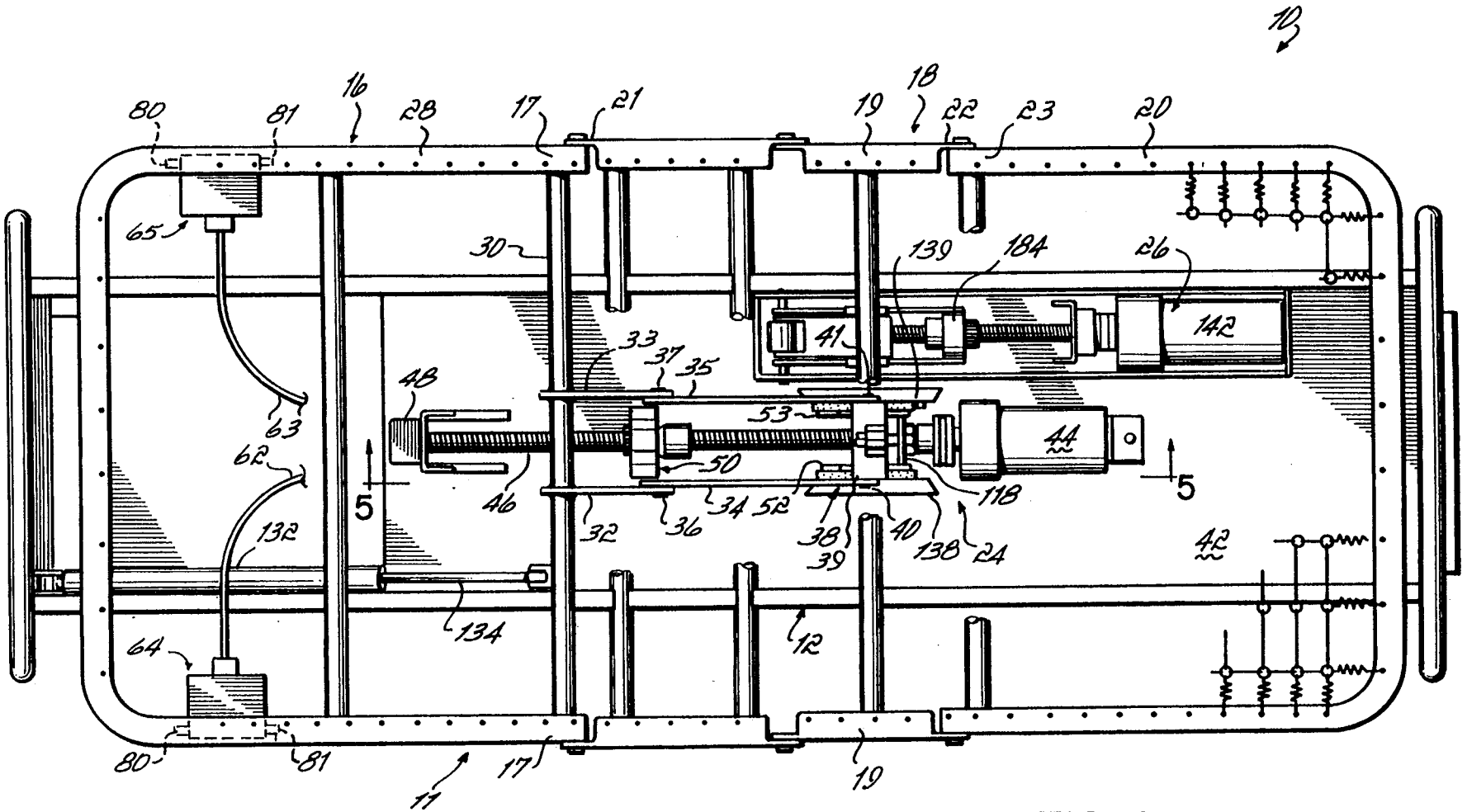
FIG. 4 is a partial top plan view of the hospital bed illustrating the release controls and drives.
Figure 5:
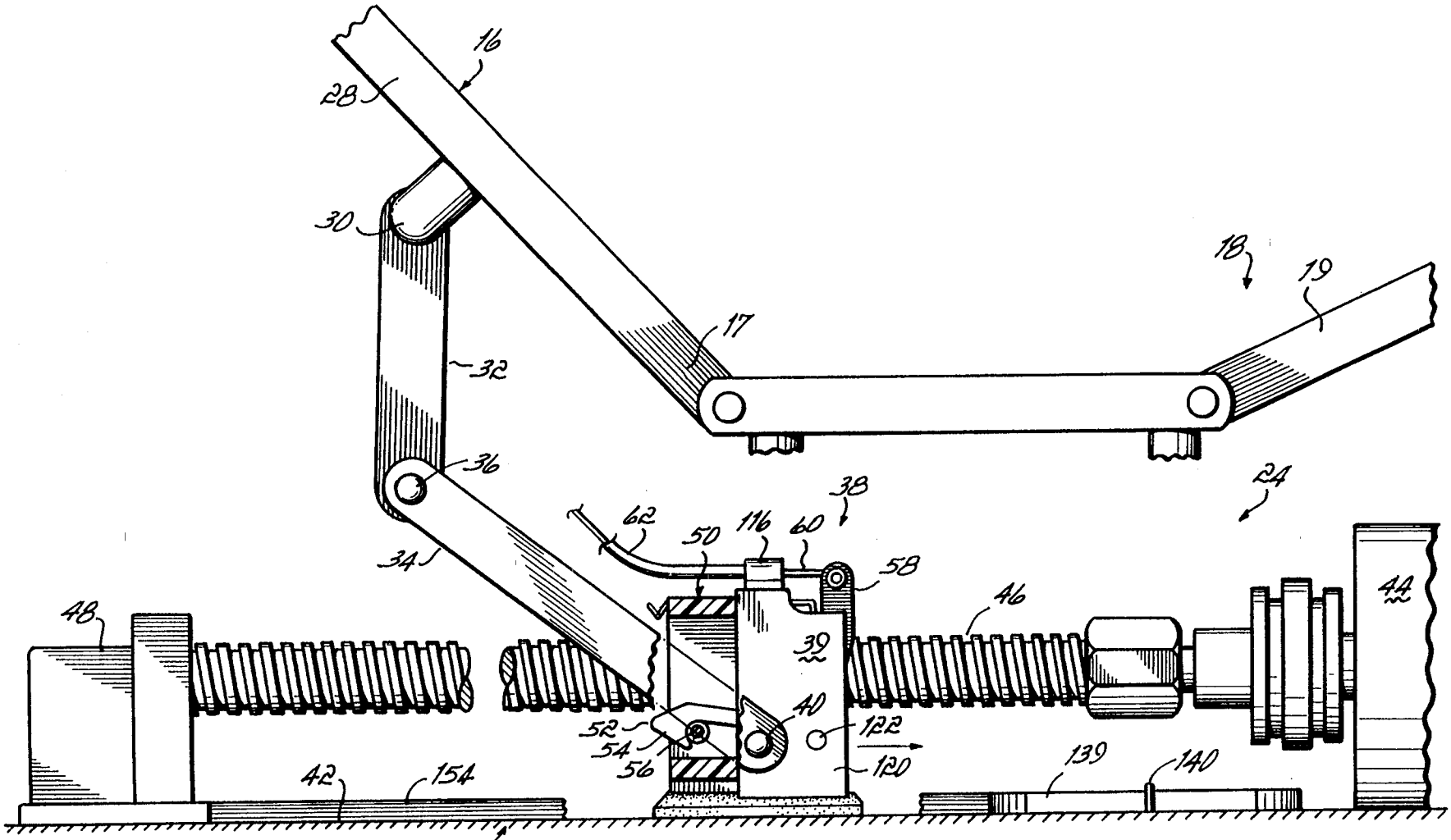
FIG. 5 is a cross-sectional view taken along line 5—5 of FIG. 4 and illustrates a partial side view of the upper body drive section engaged with the release mechanism.

FIGS. 4–9 illustrate the quick release control utilized with the present invention. Referring to FIGS. 4 and 5, the head section 16 includes an upper body frame member 28 with a cross member 30 having its ends rigidly attached to the upper body frame member 28. Each of a pair of torque arms 32, 33 have one end rigidly connected to the cross member 30 at points intermediate the ends of the cross member 30. The other ends of the torque arms 32, 33 are pivotally connected to one end of a pair of upper body drive links 34, 35 by pivot pins 36, 37. The other ends of the upper body drive links 34, 35 are pivotally connected to the release mechanism 38 by pivot pins 40, 41, thereby pivotally connecting the release mechanism to the upper body section. The release mechanism 38 has a release block 39 slidably mounted on a top surface 42 of the body support frame 12 which also supports the head drive 24. The head drive 24 includes a head drive motor 44 coupled to one end of a screw 46. The other end of the screw 46 is supported by a screw support 48. A head drive nut 50 is rotatably mounted on the screw 46 and the head drive nut 50 translates to the left or the right, as viewed in FIGS. 4–7, with respect to the longitudinal axis of the screw 46, depending on the direction of rotation of the head drive motor 44.

Figures 7, 7A:
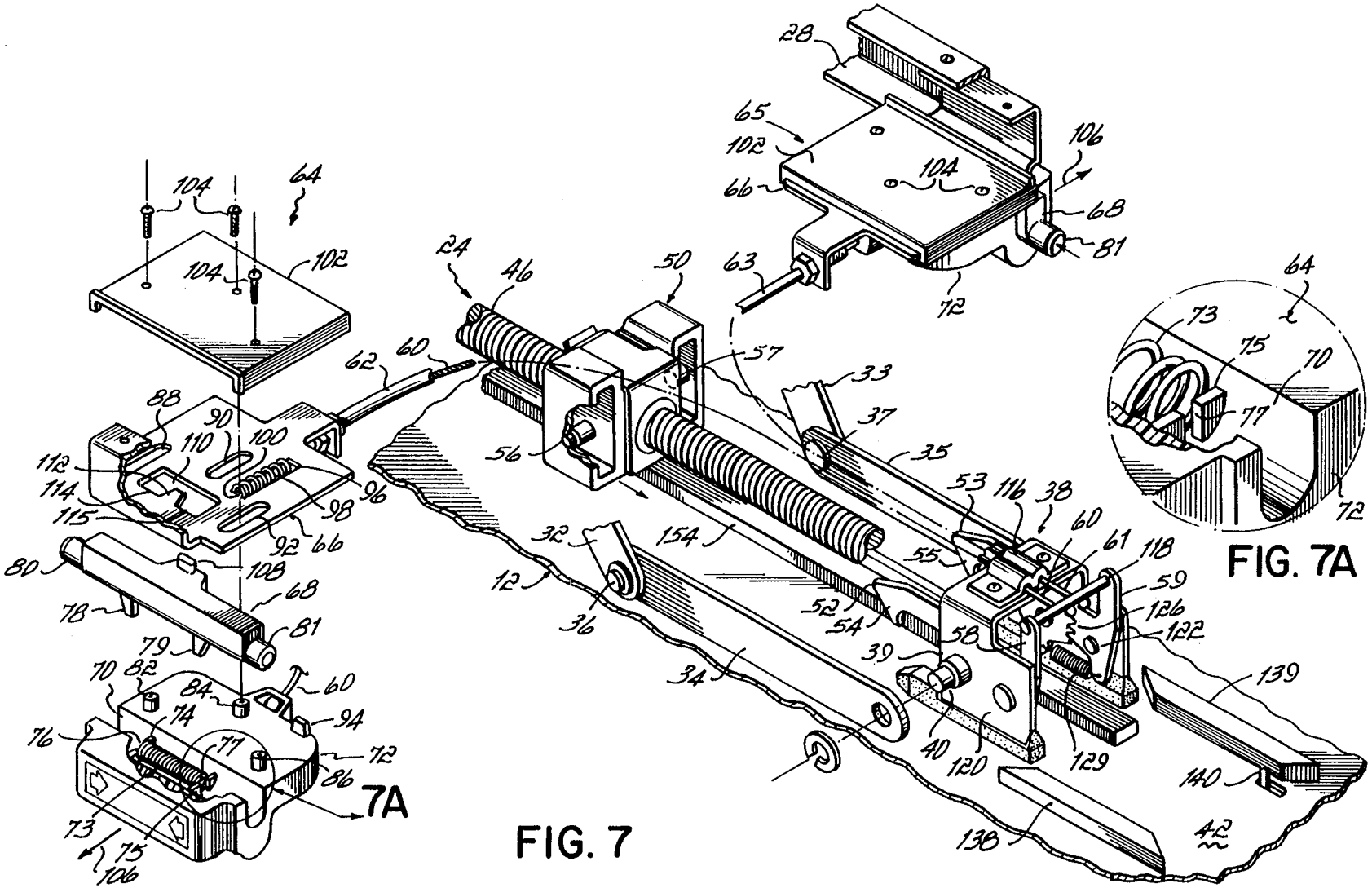
FIG. 7 is a perspective view partially disassembled and illustrating the release controls and the upper body drive.
FIG. 7A is an enlarged view of the encircled portion 7A shown in FIG. 7.

As shown in FIGS. 5 and 7, the release mechanism 38 is releasably connected to the head drive nut 50 by means of a pair of latches 52, 53 having one end pivotally connected to the release block 39. The other ends of the latches 52, 53 have hooks 54, 55 engaging latch pins 56, 57 connected to each side of the head drive nut 50 such that the latch pins 56, 57 are generally perpendicular to the screw 46. The latches 52, 53 are mechanically coupled to levers 58, 59, each having one end connected to one end of wires 60, 61 slidably located inside cables 62, 63 secured to the release mechanism.

In the event of an emergency situation in which the upper body must be quickly lowered to a predetermined, e,g., a horizontal, position, an attendant uses one of the two manual release mechanisms, or controls, 64, 65 which are located on opposite sides of the head section as illustrated in FIGS. 4 and 7. The manually actuated release control 64 is shown disassembled in FIG. 7. A mounting plate 66 is rigidly connected to the upper body frame member 28. A button bar 68 is slidably located in a slot 70 of release handle 72. A compression spring 73 is located between two end posts 74, 75 that have respective tab slots 76, 77 opening toward the top of slot 70, see FIG, 7A, The button bar 68 is inserted into the slot 70 such that the two tabs 78, 79 on the bottom of the button bar are located in the slots 76, 77, respectively, such that the ends of the compression spring 73 are captured between the tabs 78, 79. Consequently, depression of either of the buttons 80 or 81 laterally moves the button bar 68; and a respective tab 78, 79 compresses the spring 73 against an opposing end post. Therefore, when the pushed button 78, 80 is released, the compression spring 73 slides the button bar 68 back to its neutral or center position between the end posts 74, 75 within the release handle 72.

The assembly of the button bar 68 and release handle 72 is positioned against the bottom side of the mounting plate 66 such that locating pins 82, 84, 86 are slidably positioned within slots 88, 90 and 92 of the mounting plate. In assembling the release handle 72 to the mounting plate 66, compression pin 94 on release handle 72 is inserted in one end of slot 96 of mounting plate 66. A compression spring 98 has one end in contact with the compression pin 94 and another end slidably positioned over a tongue 100 of mounting plate 66 to hold the spring 98 in position. A top cover 102 is secured to the pins 82, 84, 86 by fasteners 104.

To activate the manual release control 64 or 65, an operator extends the ends of their fingers behind the manual release to pull the manual release outward in the direction indicated by the arrow 106. However, when the button bar 68 is centered within the release handle 72, a pin 108 of button bar 68 is located in opening 110 adjacent a stop 112. Consequently, any attempt to move the release handle 72 in the direction of the arrow 106 will be inhibited by the pin 108 contacting the stop 112. To eliminate the interference between the pin 108 with the stop 112 in the direction of motion indicated by the arrow 106, the button bar must be moved in a direction transverse to the direction 106. That is accomplished by pushing either of the buttons 80, 81, for example, with a thumb. Translation of the button bar 68 in its longitudinal direction will align the pin 108 with one of the slots 114, 115. With the button bar so positioned, the release handle is then free to slide relative to the longitudinal direction of the slots 88, 90, 92 of fixed mounting plate 66 in the direction of the arrow 106. The requirement of two independent actions, that is, longitudinal sliding motion of the button bar 68 perpendicular to the direction of arrow 106 and sliding motion of the release handle 72 in the direction of arrow 106 is intended to minimize inadvertent actuation of the release mechanism.

Figure 8:
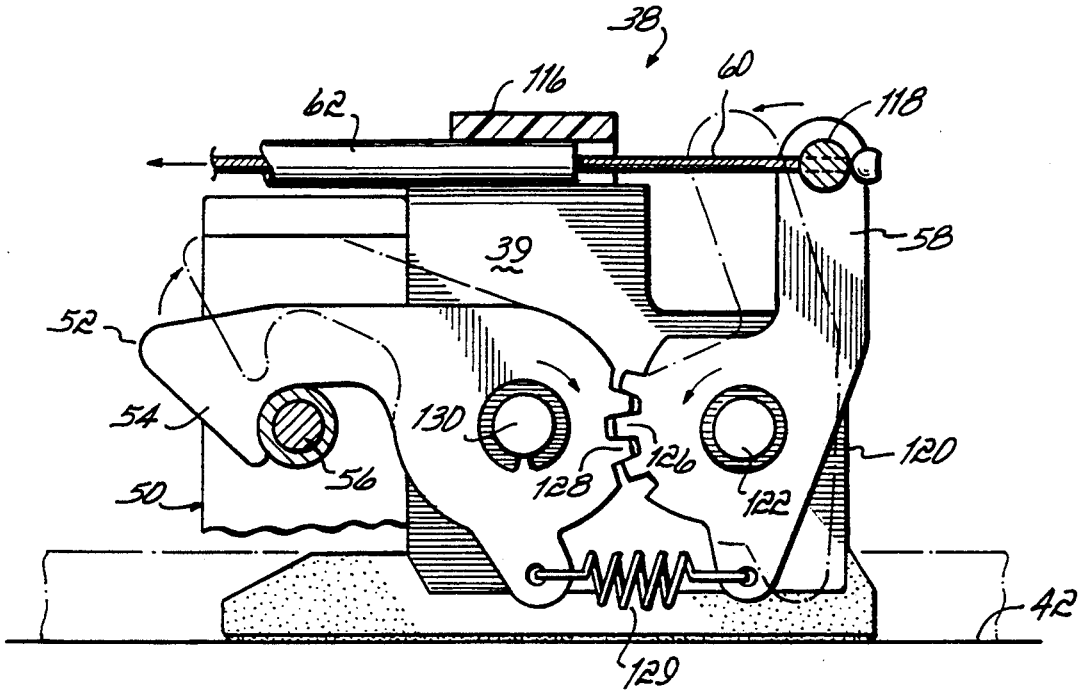
FIG. 8 is a longitudinal cross-sectional view illustrating how the release control disengages the release mechanism from the upper body drive nut.

One end of each of the cables 62, 63 is connected to the mounting plates 66, 66 of the release actuators 64, 65, respectively. The other ends of the release cables 62, 63 are connected to the release mechanism 38 by a clamp 116. One end of each of the cable wires 60, 61 within the respective release cables 62, 63 are attached to the release handles within the release controls 64, 65, respectively. The other ends of the cable wires 60, 61 are connected to a bar 118 connected between one end of levers 58, 59. The mechanical connection between the levers 58, 59 and latches 52, 53, respectively, are identical; and therefore, only the mechanical linkage between lever 58 and latch 60 will be illustrated in detail. Referring to FIG. 8, lever 58 is pivotally connected to the housing 120 by pivot pin 122. Gear teeth 126 on lever 58 mesh with gear teeth 128 on latch 52. A latch 52 is pivotally connected to the housing 120 by pivot pin 130. Consequently, when either of the cable wires 60, 61 pull the bar 118, the lever 58 rotates about pivot pin 122. Gear teeth 126 mesh with gear teeth 128 and cause latch 52 to rotate about the pivot pin 130. That rotation lifts the hook 54 off the latch pin 56 thereby disengaging the release mechanism 38 from the drive nut 50. The motion of bar 118 causes simultaneous rotation of levers 58, 59 and latches 52, 53 to simultaneously move the hooks 54, 55 away from the latch pins 56, 57, thereby disconnecting the head section from the upper drive. In addition, motion of the bar 118 stretches tension spring 129. After the attendant releases the release controls 64, 65, tension spring 129 pulls levers 58, 59 and hooks 54, 55 back toward the pins 56, 57 to the position illustrated in FIG. 8.

Figure 6:
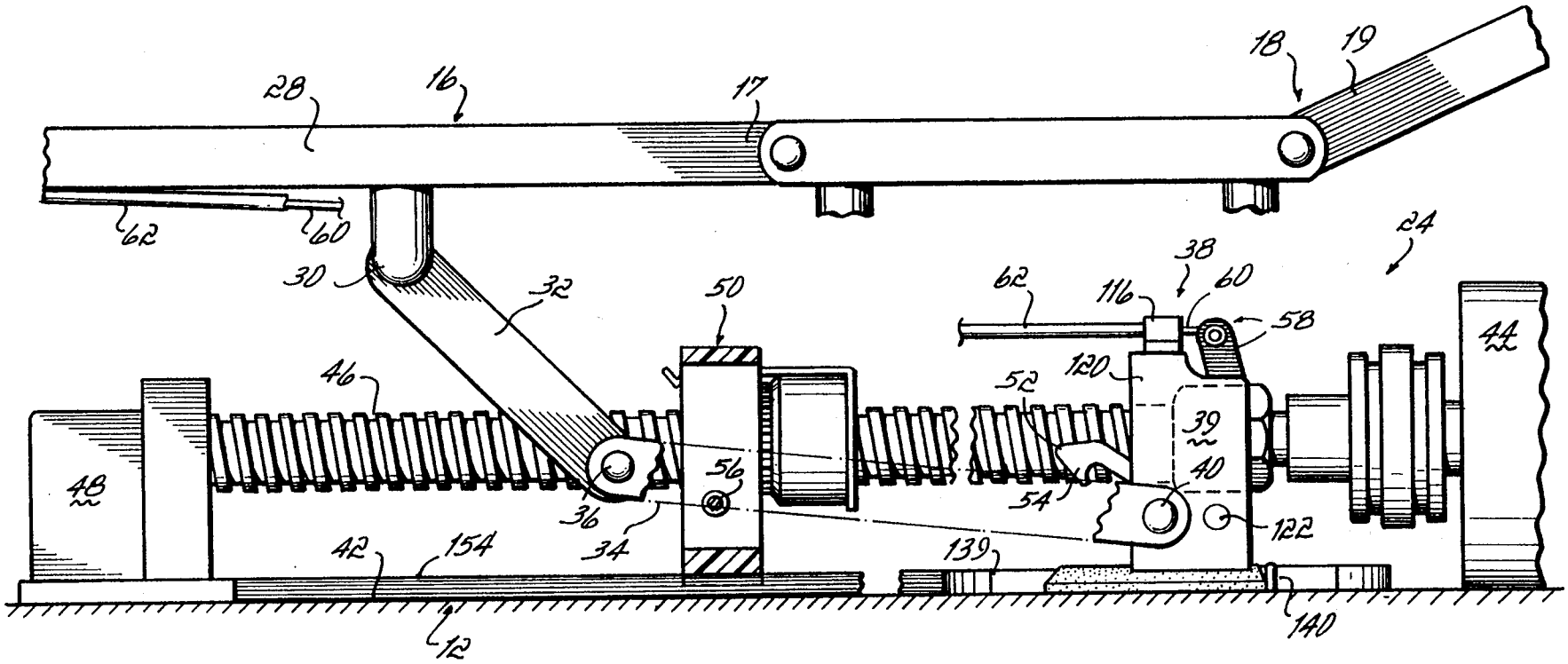
FIG. 6 is a view similar to FIG. 5 and illustrates a partial side view of the upper body drive nut disengaged from the release mechanism.

Therefore, activation of either of the release controls 64, 65 breaks the mechanical coupling between the release mechanism 38 and the head drive nut 50, thereby permitting the release mechanism 38 to move independently of the head drive nut 50. Consequently, gravitational forces exerted on the head section 16 will result in translational forces on the release mechanism 38 toward the right as viewed in FIGS. 4–7. Referring to FIG. 6, the release block 39 slides over the top surface 42 which permits the head section 16 to be pulled to its flat position by gravitational forces. Referring to FIG. 1, downward motion of the head section is limited by a damping cylinder 132 pivotally connected to the body support frame 12. The cylinder rod 134 slidably mounted within the damping cylinder 132 is pivotally connected to the cross member 30 of the head section 16. Consequently, the damping cylinder 132 lowers the head section 16 in a controlled but quick motion, for example, in a range of approximately 2 seconds–5 seconds.

With the quick release mechanism just described, the head section 16 quickly achieves the flat position illustrated in FIG. 2. However, the thigh section 19 and foot section 20 still have an inclined posture which raises the knee section 18 of the bed 10. Referring to FIG. 7, upon being released from the head drive nut 50, the release block 39 has nylon shoes 135, 136 on the bottom of each side of the release mechanism which slide along the top surface 42 of the body support frame 12. The sliding motion of the release block 39 is directed by a pair of opposed guide rails 138, 139. As the release block 39 moves between the guide rails 138, 139 the release block 39 operates a release switch 140 which automatically initiates the operation of the knee drive motor 142 and the head drive motor 44. Operation of the knee drive motor 142 causes the knee drive 26 to move the knee section 18 downward until the thigh section 19 and foot section 20 are in their flat positions coplanar with the head section 16. Operation of the head drive motor 44 rotates the screw 46 to move the head drive nut 50 toward the right as viewed in FIG. 6 until it reconnects with the release mechanism 38. To reconnect the head section with the upper drive, the head drive nut 50 moves toward release mechanism 38 until the hooks 54, 55 of latches 52, 53 engage their respective latch pins 56, 57 of the head drive nut 50. At that point, in response to the actuation of the quick release control, the head and knee sections 16 and 18, respectively, have been automatically lowered to their flat, coplanar position as illustrated in FIG. 3; and the head drive has been automatically reconnected with the head section. The entire bed lowering cycle occurred in response to a single actuation of the quick release control by an attendant.

Figure 9:
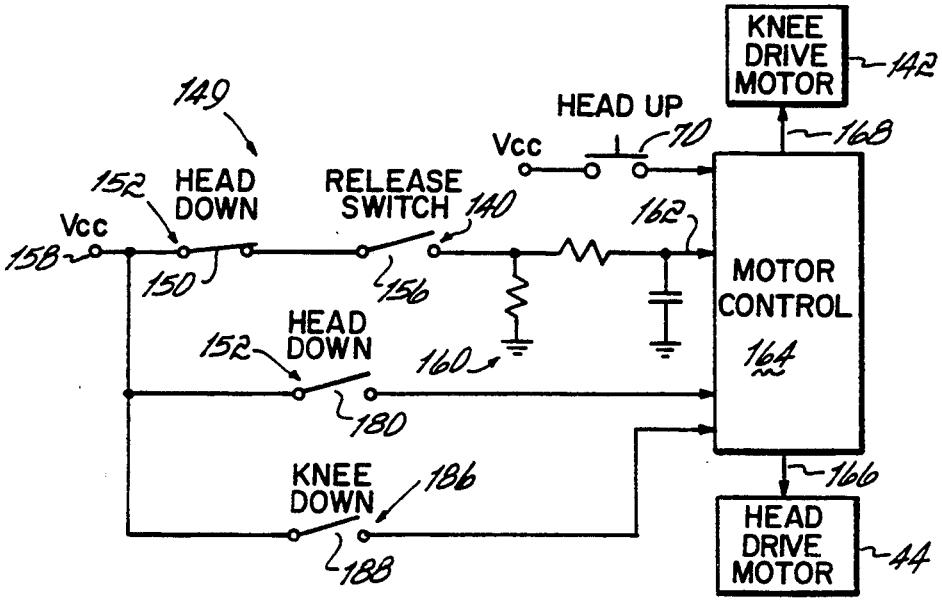
FIG. 9 is a schematic diagram illustrating the operation of the head and knee motors in response to the operation of the release control.

FIG. 9 is a schematic diagram illustrating a switching circuit 149 for automatically commanding the operation of the head and knee drive motors, 44 and 142, respectively in response to actuation of the quick release control. Normally closed contacts 150 in a head down limit switch 152, are located within the switch housing 154 of FIG. 7. The switch housing 154 contains several limit switches to detect the travel of the head drive nut 50 along the screw 46. For example, the switch housing 54 contains upper travel limit contacts to detect when the head drive nut 50 has raised the head section 16 to the maximum permissible elevation. In addition, the switch housing 154 has a head down limit switch 152 which detects when the head section 16 is in its lowermost position. Other drive systems on the hospital bed, for example, knee drive 26 also a respective switch housing to detect the upper and lower limits of motion of the knee section 18.

Typically, prior to the actuation of the release control 64, the head section 16 is in an elevated position. Therefore, the head down limit switch 152 is not activated, and the normally closed contacts 150 are closed. At that time, the release switch 140 is not actuated, and the normally open contacts 156 within release switch 140 are open. In response to the actuation of either of the release controls 64, 65, the release mechanism 38 is disengaged from the head drive nut 50 and slides over the top surface 42 until it reaches the end of its travel, at which point, it actuates release switch 140 thereby closing normally opened contacts 156. Current then flows from the power source 158 through a time delay network 160 and provides a head and knee drive command signal on an input 162 of motor control 164. The time delay circuit 160 provides a 1200 millisecond delay which at this point has no discernable effect on the operation of the system. Upon the motor control 164 receiving the head and knee drive command, output signals are produced on lines 166 and 168 which are effective to operate the head and knee drive motors 44 and 142 respectively. The command signal on line 162 functions as a trigger to initiate operation of the motors 44, 142; however, their continued operation and stopping are independent of the continued presence of the command signal on input 162.

Operation of the head drive motor 44 moves the head drive nut 50 along screw 46 back into engagement with the release mechanism 38. In addition to engaging release mechanism 38, the head drive nut 50 operates the head down limit switch 152 which opens the normally closed contacts 150 and removes the head and knee drive command signal from input 162 of motor control 164. The termination of the head and knee drive command signal on input 162 has no effect on the signals on output lines 166, 168 of the motor control. The operation of the head drive motor 44 in response to the operation of the head down limit switch 152 is controlled by the operation of previously known logic circuitry. For example, when the head drive nut 50 actuates the head down limit switch 152, normally open contacts 180 are closed. Closing normally opened contacts 180 provides a signal to the motor control 164 which is effective to stop the operation of the head drive motor 44. Similarly, operation of the knee drive motor 142 moves the thigh and foot sections 19 and 20 downward to a flat orientation. To detect the lower limit of the knee down position, the knee drive nut 184 (FIG. 4) actuates a knee down limit switch 186 thereby closing normally open contacts 188. Closure of the contacts 188 provides a knee down limit signal to the motor control 164 which stops operation of the knee drive motor 142.

Subsequently, when the attendant actuates a head up pushbutton 170 to lift the head section 16 to a raised elevation, the head drive nut 50 disengages from the head down limit switch 152 thereby closing normally closed contacts 150. In the absence of the time delay circuit 160, a head and knee drive command signal would be applied to the input 162 of motor control 164. However, the 1200 millisecond time delay, which is the time required to charge capacitor 172 through resistor 174, provides time for the release mechanism 38 moving with the head drive nut 50 to disengage from the release switch 140. A static spring resets the release switch 140 thereby opening the normally open contacts 156 before the expiration of the 1200 millisecond delay. Therefore, the head and knee drive command signal is not created on input 162 of motor control 164. The capacitor 172 subsequently discharges through resistor 176 when the contacts 156 open thereby removing the power supply 158 from the input 162.

In use, in the event of an emergency CPR situation, the attendant grabs a single one of the manual release controls 64, 65, depresses one of the buttons 80, 81 and pulls on release handle 72. That single discrete actuation of the single release control pulls hooks 54, 55 away from pins 40, 41, thereby unlatching release mechanism 38 from the upper drive nut 50 and disconnecting the upper body section 16 from the upper drive 24. The upper body section is pulled by gravity and moves rapidly in a downward direction until it reaches a flat position; however, motion of the upper body section is dampened by the cylinder 132. As the upper body section moves downward, it actuates a switch which commands the operation of the knee drive motor 142 and the head drive motor 44. The operation of the knee drive motor moves the thigh and foot sections to a coplanar position with the head section. The operation of the head drive motor moves the head drive nut 50 back into engagement with the release mechanism 38 thereby reconnecting the upper body drive 24 to the upper body section 16.

Therefore, in a CPR emergency, by disconnecting the upper drive from the upper body section, the head and chest area of the patient can be lowered to a position suitable for emergency treatment in as little as 2 seconds. In addition, in response to the same single actuation of the release control, the thigh and foot sections 19, 20 are automatically lowered into a coplanar position by initiating the operation of the knee drive motor 142. Further, in response to the same single actuation of the release control, the head drive 44 is automatically reconnected to the upper body section 16.

While the present invention has been set forth by description of the embodiments in considerable detail, it is not intended to restrict or in any way limit the claims to such detail. Additional advantages and modifications will readily appear to those who are skilled in the art. For example, in the preferred embodiment, in response to the release control 64, 65, the head section is moved to its lowermost position by gravity. Alternatively, the head motor 44 could be operated at a high speed. The disclosed embodiment utilizes a release switch 140 to actuate the knee and head motors simultaneously thereby lowering the knee section 18. Alternatively, the motor control 164 could respond to a limit switch mounted on the release controls 64, 65 or located elsewhere. Further, the release control as illustrated on the end of the head section 16 can also be mounted at other locations on the bed. The invention in its broadest aspects is therefore not limited to the specific details shown and described. Accordingly, departures may be made from such details without departing from the spirit and scope of the invention.

What is claimed is:

1. A bed comprising:

a body support assembly having an upper body section, a lower body section pivotally connected to the upper body section, a lower drive connected to the lower body section for moving the lower body section to different positions;

an upper drive;

a release mechanism connected to the upper body section for releasably connecting the upper body section to the upper drive thereby allowing the upper drive to move the upper body section to different positions; and a manual release control connected to the release mechanism for causing the release mechanism to disconnect the upper body section and the upper drive in response to an actuation of the manual release control, thereby permitting the upper body section to move in a generally downward direction independent of the upper drive; and a switching circuit responsive to the actuation of the manual release control for automatically commanding motion of the lower body section in the generally downward direction.

2. The bed of claim 1 wherein the switching circuit is further responsive to the actuation of the manual release control for commanding operation of the upper drive to reconnect the upper drive to the upper body section.

3. The bed of claim 1 wherein the switching circuit includes a switch mechanism responsive to the upper body section moving in the generally downward direction.

4. The bed of claim 3 wherein the switch mechanism commands the upper drive to move the upper drive into a connecting relationship with the upper body section.

5. The bed of claim 1 wherein the upper body section and the lower body section move in the generally downward direction into an approximately coplanar relationship.

6. The bed of claim 1 wherein the upper body section moves to an approximately horizontal position in less than four seconds.

7. The bed of claim 1 wherein the upper drive includes:

a drive screw adapted to be connected to the actuator;

a lift nut rotatably mounted to the drive screw, the lift nut translating along the drive screw in response to rotation of the drive screw, and a latch mechanism for releasably connecting the release mechanism with the lift nut.

8. The bed of claim 7 wherein the bed further includes a frame member for supporting the upper drive, and the release mechanism includes a release block pivotally connected to the upper body section and slidably supported on the frame member, the release mechanism.

9. The bed of claim 8 wherein the latch mechanism includes a pin connected to the lift nut such that the pin is generally perpendicular to the drive screw; and a latch pivotally connected to the release mechanism and having a hook proximate an end of the latch to engage the pin of the lift nut.

10. The bed of claim 9 wherein the release mechanism further includes:

a lever pivotally connected to the release block and the lever having one end mechanically coupled to the latch; and a spring connected between the latch and the lever and biasing the latch toward a latched position by pulling the hook over the pin of the lift nut, thereby connecting the release mechanism to the lift nut.

11. The bed of claim 10 wherein the includes a manual release control connected to the frame member and mechanically connected to an opposite end of the lever so that actuation of the manual release control moves the lever and latch to an unlatched position by moving the hook away from the pin on the lift nut, thereby disconnecting the release mechanism from the lift nut and allowing the head section to be pulled downward by gravity and causing the release mechanism to slide along the frame member.

12. The bed of claim 11 wherein the manual release control includes:

a mounting plate connected to the frame member;

a release handle slidably mounted with respect to the mounting plate;

a spring located between the mounting plate and the release handle for biasing the release handle toward a first position; and a cable located between the release handle and the opposite end of the lever for moving the opposite end of the lever in response to motion of the release handle.

13. The bed of claim 12 wherein the manual release control further includes:

a bar disposed between the release handle and the mounting plate;

a spring located between the bar and the mounting plate for biasing the bar to a locking position relative to the release handle so that the release handle is locked in the first position in response to the bar being in the locking position, whereby applying a force to the bar to move the bar to an unlocking position unlocks the release handle thereby permitting motion of the release handle to a second position.

14. A bed having an upper body section pivotally connected to a lower body section, a lower drive connected to the lower body section and an upper drive, the bed including a release mechanism pivotally connected to the upper body section and releasably connected to the upper drive to disconnect the upper drive from the upper body section in response to a first actuation of the release mechanism, thereby permitting the upper body section to be pulled in a generally downward direction by gravity, the bed comprising a switching circuit responsive to the first actuation of the release mechanism for commanding an operation of the lower drive to initiate motion of the lower body section in a generally downward direction.

15. The bed of claim 14 wherein the switching circuit further commands operation of the upper drive in response to the first actuation of the release mechanism to move the upper drive into a connecting relationship with the upper body section.

16. The bed of claim 14 wherein the switching circuit further includes:

a release switch responsive to the upper body section moving in the generally downward direction for producing a command signal;

a control responsive to the command signal for producing a first output signal to operate the lower drive and move the lower body section in the generally downward direction.

17. The bed of claim 16 wherein the switching circuit further includes an upper body down limit switch having a set of normally closed contacts, and the release switch has a set of normally open contacts, and the command signal is generated in response to the set of normally closed contacts being closed and the set of normally open contacts being closed.

18. The bed of claim 17 wherein the command signal is generated a predetermined period of time after the set of normally open contacts close simultaneously with the set of normally closed contacts being closed and during the predetermined period of time, both sets of the normally open contacts and the normally closed contacts remain closed.

19. The bed of claim 18 wherein the predetermined period of time is 1200 milliseconds.

20. The bed of claim 17 wherein the switching circuit further includes a lower body down limit switch and the first output signal is terminated in response to the lower body section activating the lower body down limit switch.

21. The bed of claim 16 wherein the control is responsive to the command signal for producing a second output signal to operate the upper drive and move the upper drive into a connecting relationship with the upper body section.

22. The bed of claim 19 wherein the switching circuit further includes an upper body down limit switch and the second output signal is terminated in response to the upper body section activating the upper body down limit switch.

23. A bed comprising:

a body support frame;

a head section having one end;

a thigh section having one end pivotally linked to the one end of the head section;

a foot section having one end pivotally connected to an opposite end of the thigh section;

a lower drive mounted on the body support frame in mechanical communication with the thigh and the foot sections for moving the thigh and the foot sections to different inclined positions;

an upper drive mounted on the body support frame and in mechanical communication with the head section for moving the head section to different inclined positions;

a release mechanism mechanically connected between the upper drive and the head section for disconnecting the upper drive from the head section in response to an actuation of the release mechanism, thereby permitting the head section to move in a generally downward direction in response to a gravitational force and independent of the upper drive; and a release switch connected to the body support frame and operating the upper drive in response to the actuation of the release mechanism to move the upper drive into a connecting relationship with the head section and the release switch operating the lower drive to move the thigh and the foot sections in the generally downward direction, whereby the head, the thigh and the foot sections move into an approximately coplanar relationship.

24. The bed of claim 23 wherein the release switch is responsive to the head section moving in the generally downward direction.

25. A bed comprising:

a body support assembly having an upper body section, a lower body section pivotally connected to the upper body section, a lower drive connected to the lower body section for moving the lower body section to different positions;

an upper drive;

means connected to the upper body section for releasably connecting the upper body section to the upper drive thereby allowing the upper drive to move the upper body section to different positions; and manually actuated means connected to the means for releasably connecting for disconnecting the upper body section and the upper drive in response to a actuation of the manually actuated means, thereby permitting the upper body section to move in a generally downward direction independent of the upper drive; and means responsive to the actuation of the manually actuated means for automatically initiating motion of the lower body section in the generally downward direction.

26. The bed of claim 25 wherein the means for automatically initiating motion is further responsive to the actuation of the manually actuated means for operating the upper drive to reconnect the upper drive to the upper body section.

* * * * *